US008413715B2

(12) United States Patent
Saito et al.

(10) Patent No.: US 8,413,715 B2
(45) Date of Patent: Apr. 9, 2013

(54) REFRIGERANT EVAPORATOR WITH U-TURN BLOCK AND REFRIGERANT-DISTRIBUTING HOLES

(75) Inventors: Katsuhiro Saito, Aichi (JP); Yasunobu Zyoubouji, Aichi (JP); Takamitsu Himeno, Aichi (JP); Hitoshi Tamaki, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 12/441,989

(22) PCT Filed: Jul. 25, 2008

(86) PCT No.: PCT/JP2008/063368
§ 371 (c)(1),
(2), (4) Date: Mar. 19, 2009

(87) PCT Pub. No.: WO2009/017042
PCT Pub. Date: Feb. 5, 2009

(65) Prior Publication Data

US 2009/0266528 A1 Oct. 29, 2009

(30) Foreign Application Priority Data

Jul. 27, 2007 (JP) ..... 2007-195504

(51) Int. Cl.
*F28F 9/22* (2006.01)

(52) U.S. Cl.
USPC ..... 165/153; 165/174

(58) Field of Classification Search ..... 165/153, 165/174, 175
See application file for complete search history.

(56) References Cited

U.S. PATENT DOCUMENTS 5,680,897 A * 10/1997 Kilmer ..... 165/178
5,909,766 A * 6/1999 Kobayashi et al. ..... 165/70
6,272,881 B1 * 8/2001 Kuroyanagi et al. ..... 62/525
(Continued)

FOREIGN PATENT DOCUMENTS

EP 1310757 A2 10/2002
JP 6-26780 A 2/1994
(Continued)

OTHER PUBLICATIONS

International Search Report of PCT/JP2008/063368, Mailing Date of Sep. 30, 2008.

*Primary Examiner* — Allen Flanigan
(74) *Attorney, Agent, or Firm* — Westerman, Hattori, Daniels & Adrian, LLP

(57) ABSTRACT

A refrigerant evaporator is provided in which a liquid refrigerant can be evenly distributed to a plurality of refrigerant tubes connected to first and second tanks in a U-turn block to improve heat-exchange performance. In the refrigerant evaporator, one of a plurality of blocks into which a refrigerant supply channel is divided is a U-turn block where a refrigerant flows into one of the first and second tank portions of an upper tank in a direction along a partition wall, flows into the other tank portion, and is distributed and flows from the first and second tank portions into a plurality of refrigerant tubes. The partition wall partitioning the first and second tank portions of the upper tank has a plurality of refrigerant-distributing holes arranged in a longitudinal direction of the partition wall in the U-turn block so that the first tank portion communicates with the second tank portion.

4 Claims, 8 Drawing Sheets

U.S. PATENT DOCUMENTS

| | | | | |
|---|---|---|---|---|
| 6,431,264 | B2 * | 8/2002 | Tooyama et al. | 165/153 |
| 6,742,577 | B2 * | 6/2004 | Joboji et al. | 165/153 |
| 7,040,385 | B2 * | 5/2006 | Higashiyama | 165/153 |
| 7,523,781 | B2 * | 4/2009 | Oh et al. | 165/153 |
| 7,571,761 | B2 * | 8/2009 | Katoh et al. | 165/174 |
| 7,650,935 | B2 * | 1/2010 | Demuth et al. | 165/176 |
| 7,886,812 | B2 * | 2/2011 | Higashiyama | 165/174 |
| 8,037,929 | B2 * | 10/2011 | Higashiyama | 165/153 |
| 2004/0159121 | A1 * | 8/2004 | Horiuchi et al. | 165/153 |
| 2004/0256091 | A1 | 12/2004 | Higashiyama | |
| 2005/0039901 | A1 * | 2/2005 | Demuth et al. | 165/175 |
| 2005/0172664 | A1 * | 8/2005 | Cho et al. | 62/515 |
| 2006/0144577 | A1 | 7/2006 | Higashiyama | |
| 2007/0158057 | A1 | 7/2007 | Higashiyama | |

FOREIGN PATENT DOCUMENTS

| | | | |
|---|---|---|---|
| JP | 10-157447 | A | 6/1998 |
| JP | 2001-074388 | A | 3/2001 |
| JP | 2001-221535 | A | 8/2001 |
| JP | 2001-255095 | A | 9/2001 |
| JP | 2003-130581 | A | 5/2003 |
| JP | 2003-148833 | A | 5/2003 |
| JP | 2003-207229 | A | 7/2003 |
| JP | 2004-144395 | A | 5/2004 |
| JP | 2005-241170 | A | 9/2005 |
| JP | 2006-170598 | A | 6/2006 |

* cited by examiner

REFRIGERANT EVAPORATOR WITH U-TURN BLOCK AND REFRIGERANT-DISTRIBUTING HOLES

TECHNICAL FIELD

The present invention relates to refrigerant evaporators for installation in refrigeration cycles, and particularly to refrigerant evaporators suitable for use in vehicle air conditioners.

BACKGROUND ART

One known refrigerant evaporator for use in a refrigeration cycle of a vehicle air conditioner includes many refrigerant tubes that have refrigerant flow channels through which a refrigerant flows in a vertical direction, that are arranged in parallel in a direction perpendicular to a flow direction of air flowing outside the refrigerant flow channels, and that are arranged in a plurality of rows from front to rear in the flow direction of the air; and a pair of upper and lower tanks for distributing or collecting the refrigerant, disposed in the direction perpendicular to the flow direction of the air and connected to top ends and bottom ends, respectively, of the many refrigerant tubes, each tank having a partition wall partitioning the interior thereof into a first tank portion and a second tank portion that correspond to the plurality of rows of the refrigerant tubes in a row direction. The refrigerant evaporator is configured such that the refrigerant, flowing in through a refrigerant inlet, flows sequentially into the refrigerant tubes in a plurality of blocks partitioned by partition plates disposed at a plurality of positions in the tanks to undergo heat exchange with the air, thereby cooling the air.

Patent Document 1 discloses a refrigerant evaporator having the above configuration in which one of the plurality of blocks is a U-turn block where the refrigerant flows into the first tank portion of the upper tank in a direction along the partition wall, flows from the first tank portion into the second tank portion through a side refrigerant channel, and is distributed and flows from the first and second tank portions into the plurality of refrigerant tubes. Patent Document 2 discloses a refrigerant evaporator in which a plurality of communication holes are provided in the partition wall so that the refrigerant collected in the second tank portion of the upper tank through the plurality of refrigerant tubes flows directly into the first tank portion on the opposite side of the partition wall.

Patent Document 1:

Publication of Japanese Patent No. 3637314

Patent Document 2:

Japanese Unexamined Patent Application, Publication No. 2001-74388

DISCLOSURE OF INVENTION

For the refrigerant evaporator disclosed in Patent Document 1 above, however, the liquid refrigerant flowing from the first tank portion into the second tank portion may be insufficiently supplied to its farthest side because the liquid refrigerant tends to flow into the near-side refrigerant tubes in the U-turn block of the upper tank, which is disposed on the top side, in a refrigerant flow direction under the effect of inertia. As a result, the liquid refrigerant is unevenly distributed to the plurality of refrigerant tubes connected to the second tank portion, thus leaving a portion where heat exchange with the air flowing outside the refrigerant tubes does not occur effectively. This causes the problem of decreased heat-exchange performance.

For the refrigerant evaporator disclosed in Patent Document 2 above, on the other hand, the plurality of communication holes, provided in the partition wall partitioning the first and second tank portions, are intended to allow the refrigerant collected in the second tank portion of the upper tank to flow directly into the first tank portion on the opposite side of the partition wall; this publication does not suggest that the liquid refrigerant flowing into the first tank portion of the upper tank in the direction along the partition wall is evenly distributed to the entire region of the first and second tank portions, which constitute the U-turn block of the upper tank, within the U-turn block in the longitudinal direction thereof.

An object of the present invention, which has been made in light of the above circumstances, is to provide a refrigerant evaporator in which a liquid refrigerant can be evenly distributed to a plurality of refrigerant tubes connected to first and second tanks in a U-turn block to improve heat-exchange performance.

To solve the above problem, a refrigerant evaporator of the present invention employs the following solutions.

Specifically, a refrigerant evaporator according to an aspect of the present invention includes many refrigerant tubes that have refrigerant flow channels through which a refrigerant flows in a vertical direction, that are arranged in parallel in a direction perpendicular to a flow direction of an external fluid flowing outside the refrigerant flow channels, and that are arranged in a plurality of rows from front to rear in the flow direction of the external fluid; and a pair of upper and lower tanks for distributing or collecting the refrigerant, disposed in the direction perpendicular to the flow direction of the external fluid and connected to top ends and bottom ends, respectively, of the many refrigerant tubes, each tank having a partition wall partitioning the interior thereof into a first tank portion and a second tank portion that correspond to the plurality of rows of the refrigerant tubes in a row direction. The tanks have a refrigerant inlet and a refrigerant outlet, and the refrigerant flows in through the refrigerant inlet, flows sequentially into the refrigerant tubes in a plurality of blocks partitioned by partition plates disposed at a plurality of positions in the tanks, and flows out through the refrigerant outlet. One of the plurality of blocks is a U-turn block where the refrigerant flows into one of the first and second tank portions of the upper tank in a direction along the partition wall, flows into the other tank portion, and is distributed and flows from the first and second tank portions into the plurality of refrigerant tubes. The partition wall partitioning the first and second tank portions of the upper tank has a plurality of refrigerant-distributing holes arranged in a longitudinal direction of the partition wall in the U-turn block so that the first tank portion communicates with the second tank portion.

According to the above aspect, in the U-turn block, a liquid refrigerant contained in a gas-liquid two-phase refrigerant flowing into one of the first and second tank portions in the direction along the partition wall is sequentially distributed to the other tank portion through the plurality of refrigerant-distributing holes arranged in the longitudinal direction of the partition wall, so that the liquid refrigerant can flow substantially evenly into the entire region of the first and second tank portions within the U-turn block in the refrigerant flow direction. This allows the liquid refrigerant to be substantially evenly distributed to the plurality of refrigerant tubes connected to the first and second tank portions. Accordingly, the distribution of the liquid refrigerant to the plurality of refrigerant tubes, which contributes primarily to the cooling of the external fluid, becomes more even, thus improving the heat-exchange performance of the refrigerant evaporator.

In the above refrigerant evaporator, additionally, the plurality of refrigerant-distributing holes may be concentrated in a far-side region of the U-turn block, excluding a near-side region of the U-turn block, in a refrigerant flow direction.

In the above configuration, because the plurality of refrigerant-distributing holes are concentrated in the far-side region, excluding the near-side region, in the refrigerant flow direction, the liquid refrigerant, which tends to be distributed more to the near-side refrigerant-distributing holes by inertia, can be sequentially shifted in distribution to the refrigerant-distributing holes on the far side on the whole, so that the distribution of the liquid refrigerant, flowing from one of the first and second tank portions into the other tank portion, in the refrigerant flow direction can be improved. This allows the liquid refrigerant to be substantially evenly distributed over the entire region of the first and second tank portions in the refrigerant flow direction. Accordingly, the distribution of the liquid refrigerant to the plurality of refrigerant tubes becomes even, thus improving the heat-exchange performance of the refrigerant evaporator.

In the refrigerant evaporator having the above configuration, if the length from the farthest end of the U-turn block to the position of the extreme near-side refrigerant-distributing hole in the refrigerant flow direction is L1 and the whole length of the U-turn block in the refrigerant flow direction is L2, the far-side region where the refrigerant-distributing holes are provided may satisfy $0.7<L1/L2<0.9$.

If the plurality of refrigerant-distributing holes are provided in a far-side region, excluding the near-side region, that satisfies $0.7<L1/L2<0.9$ in the refrigerant flow direction, the liquid refrigerant flowing from one of the first and second tank portions into the other tank portion can be more evenly distributed than in the case where the refrigerant-distributing holes are provided over the entire region. Specifically, if L1/L2 falls below 0.7, the liquid refrigerant tends to be slightly insufficiently distributed to the near-side region of the other tank portion. If L1/L2 exceeds 0.9, on the other hand, the liquid refrigerant tends to be slightly insufficiently distributed to the farthest region. If the refrigerant-distributing holes are provided in the region described above, the distribution of the liquid refrigerant to the plurality of refrigerant tubes becomes even, thus improving the heat-exchange performance of the refrigerant evaporator.

In one of the above refrigerant evaporators, the opening area of the plurality of refrigerant-distributing holes may increase gradually from the near side to the far side of the U-turn block in the refrigerant flow direction.

In the above case, because the opening area of the refrigerant-distributing holes increases gradually from the near side to the far side of the U-turn block in the refrigerant flow direction, the liquid refrigerant, which tends to be distributed more to the near-side refrigerant-distributing holes by inertia, can be sequentially shifted in distribution to the refrigerant-distributing holes with larger opening areas on the far side, so that the distribution of the liquid refrigerant, flowing from one of the first and second tank portions into the other tank portion, in the refrigerant flow direction can be improved. This allows the liquid refrigerant to be substantially evenly distributed over the entire region of the first and second tank portions in the refrigerant flow direction. Accordingly, the distribution of the liquid refrigerant to the plurality of refrigerant tubes becomes even, thus improving the heat-exchange performance of the refrigerant evaporator.

In one of the above refrigerant evaporators, the refrigerant-distributing holes may be circular holes.

In the above case, because the refrigerant-distributing holes are circular holes, stress concentration on the portions of the partition walls in which the refrigerant-distributing holes are provided can be alleviated. This increases the pressure strength of the entire tanks.

According to the present invention, the liquid refrigerant contained in the gas-liquid two-phase refrigerant flowing in the direction along the partition wall can flow into the first and second tank portions in the U-turn block formed in the upper tank while being substantially evenly distributed over the entire region thereof in the refrigerant flow direction. Accordingly, the distribution of the liquid refrigerant to the plurality of refrigerant tubes connected to the first and second tank portions becomes more even, thus improving the heat-exchange performance of the evaporator.

EXPLANATION OF REFERENCE SIGNS

Figure 1:
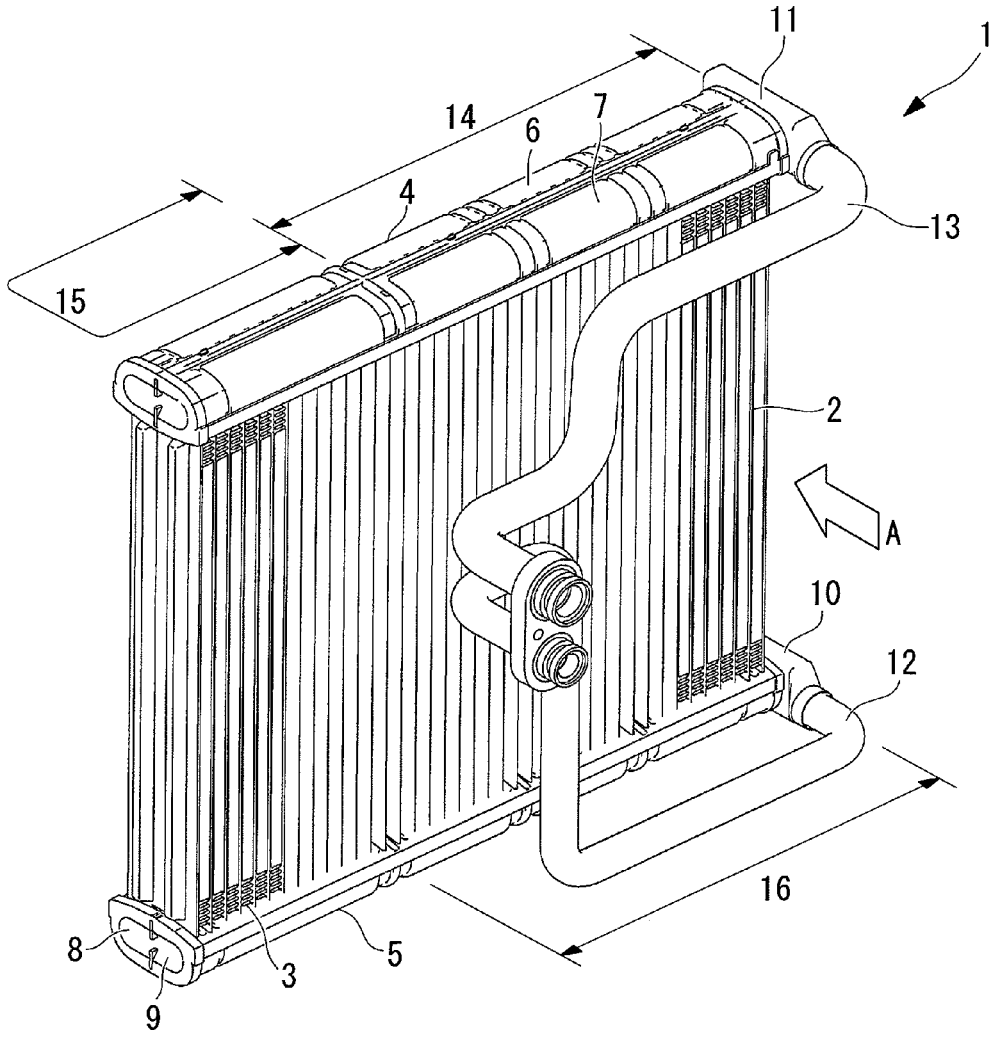
FIG. 1 is a perspective view of a refrigerant evaporator according to a first embodiment of the present invention.

1: refrigerant evaporator
2: refrigerant tube
2A: refrigerant flow channel
4: upper tank
5: lower tank
4C, 5C: partition wall
4G: refrigerant outlet
4H, 5H: partition plate
4M, 5M: refrigerant-distributing hole
5G: refrigerant inlet
6, 8: first tank portion
7, 9: second tank portion
14: first block
15: second block (U-turn block)
16: third block

BEST MODE FOR CARRYING OUT THE INVENTION

Embodiments of the present invention will now be described with reference to the drawings.

First Embodiment

Figure 2:
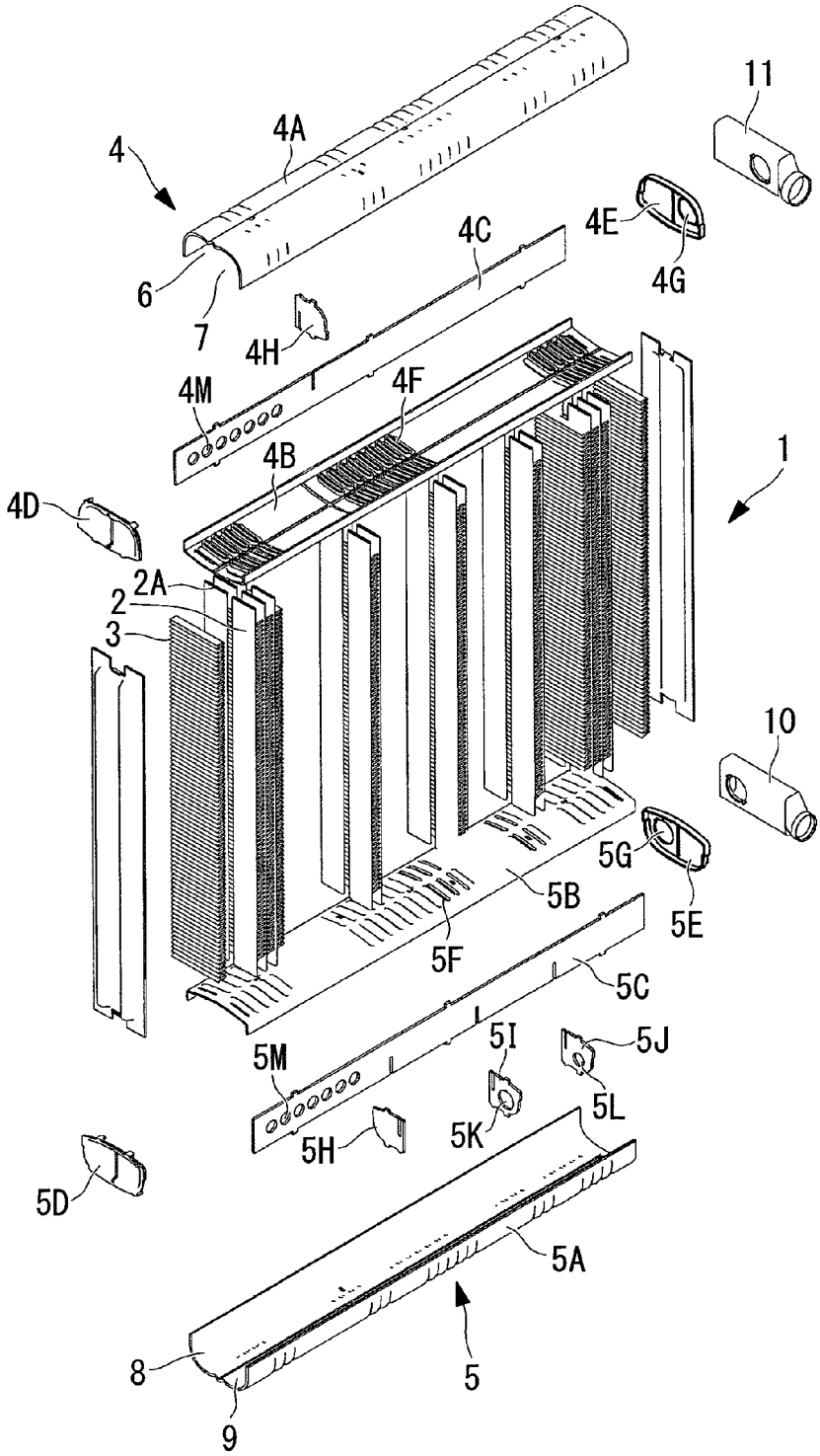
FIG. 2 is an exploded perspective view of the refrigerant evaporator shown in FIG. 1.
Figure 3A:
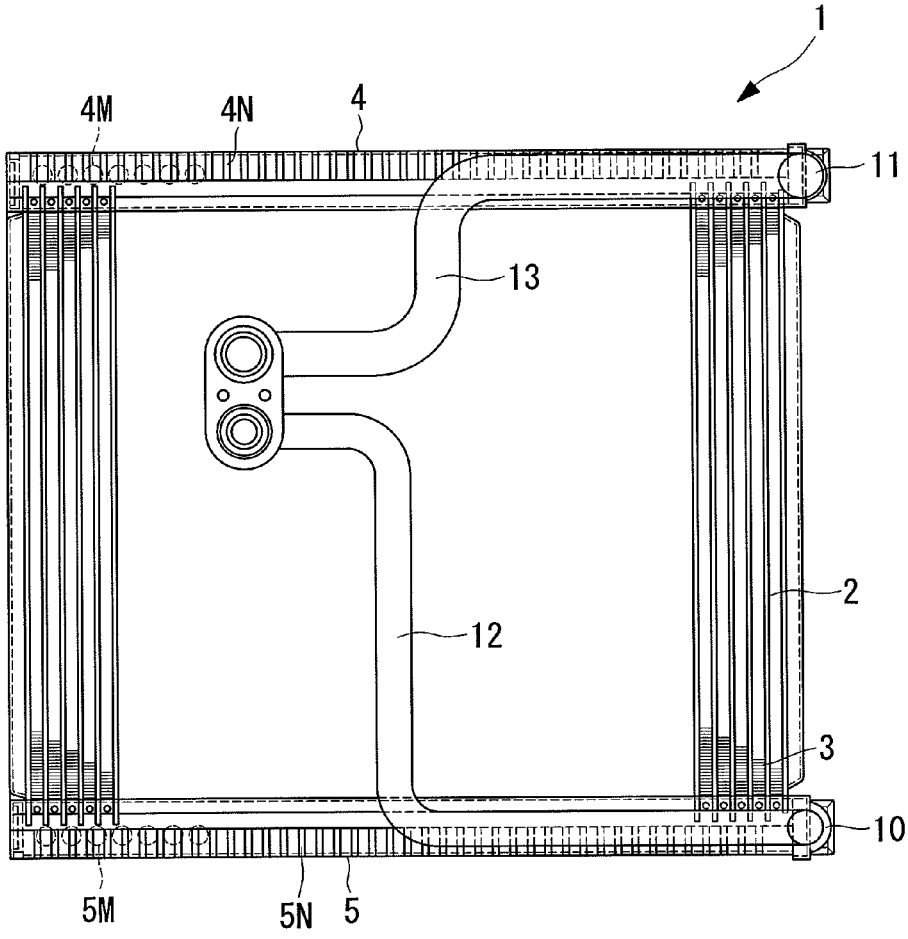
FIG. 3A is a front view of the refrigerant evaporator shown in FIG. 1.
Figure 3B:
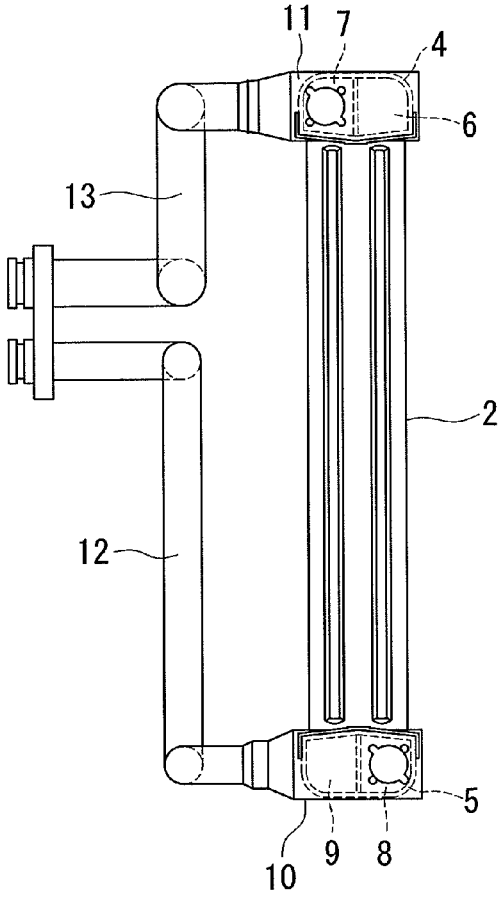
FIG. 3B is a right side view of the refrigerant evaporator shown in FIG. 1.

A first embodiment of the present invention will now be described with reference to FIGS. 1 to 4 and 6A, 6B, and 6C. FIG. 1 shows a perspective view of a refrigerant evaporator 1 according to the first embodiment of the present invention; FIG. 2 shows an exploded perspective view thereof; FIG. 3A shows a front view thereof; FIG. 3B shows a right side view thereof. The refrigerant evaporator 1 includes many refrigerant tubes 2 having a plurality of refrigerant flow channels 2A along the longitudinal direction. These refrigerant tubes 2 may be composed of aluminum alloy flat tubes produced by, for example, extrusion molding or drawing, or by forming a plate into the shape of an elliptical cylinder, with inner fins housed therein.

The many refrigerant tubes 2 are arranged in layers in parallel in a direction perpendicular to the flow direction of an external fluid (air) A flowing outside the refrigerant tubes 2. The refrigerant tubes 2 are also arranged in a plurality of rows (two rows) from front to rear in the flow direction of the air A. Between the many refrigerant tubes 2, arranged in many layers in parallel in the direction perpendicular to the flow direction of the air A, are separated by heat transfer fins 3 formed of, for example, aluminum alloy thin plates corrugated into a wavy shape. The heat transfer fins 3 are brazed to the outer surfaces of the refrigerant tubes 2 by a known method.

An upper tank 4 and a lower tank 5, each having a substantially elliptical cross section, are brazed to the top ends and bottom ends, respectively, of the many refrigerant tubes 2. The upper tank 4 and the lower tank 5 include, respectively, upper members 4A and 5A and lower members 4B and 5B that are separated in the vertical direction, partition walls 4C and 5C partitioning the interior of the upper tank 4 into a first tank portion 6 and a second tank portion 7 that correspond to the plurality of rows of the refrigerant tubes 2 in the row direction and the interior of the lower tank 5 into a first tank portion 8 and a second tank portion 9 that correspond to the plurality of rows of the refrigerant tubes 2 in the row direction, and cap members 4D and 5D and cap members 4E and 5E for closing the respective ends of the upper tank 4 and the lower tank 5. The upper members 4A and 5A, the lower members 4B and 5B, the partition walls 4C and 5C, and the cap members 4D, 5D, 4E, and 5E are formed of aluminum alloy pressed materials and are brazed together by a known method.

The lower members 4B and 5B, constituting the upper tank 4 and the lower tank 5, have many tube insertion slots 4F and 5F, respectively, corresponding to the arrangement of the refrigerant tubes 2, in which the ends of the many refrigerant tubes 2 are inserted before they are brazed together. The cap member 5E of the lower tank 5 has a refrigerant inlet 5G communicating with the second tank portion 7, and a refrigerant inlet header 10 is brazed thereto so as to communicate with the refrigerant inlet 5G of the cap member 5E. The cap member 4E of the upper tank 4, on the other hand, has a refrigerant outlet 4G communicating with the first tank portion 6, and a refrigerant outlet header 11 is brazed thereto so as to communicate with the refrigerant outlet 4G of the cap member 4E. The refrigerant inlet header 10 and the refrigerant outlet header 11 are connected to a refrigerant inlet pipe 12 and a refrigerant outlet pipe 13, respectively.

In the upper tank 4 and the lower tank 5 accommodate partition plates 4H and 5H, respectively, partitioning the second tank portion 7 of the upper tank 4 and the first tank portion 8 of the lower tank 5 into two left and right regions in the direction perpendicular to the flow direction of the air A (in the tank longitudinal direction). In this embodiment, the partition plates 4H and 5H are positioned such that the ratio of the number of refrigerant tubes 2 in the left regions, as shown, of the two left and right partitioned regions to the number of refrigerant tubes 2 in the right regions approaches 1:2. In the second tank portion 9 of the lower tank 5, particularly, two aperture plates 5I and 5J having apertures 5K and 5L, respectively, are disposed in the right region, as shown, at two appropriate positions separated by a predetermined distance in the tank longitudinal direction such that the aperture diameter decreases gradually toward the end on the cap member 5E side.

In addition, the partition walls 4C and 5C of the upper and lower tanks 4 and 5 have a plurality of refrigerant-distributing holes 4M and 5M, respectively, arranged in the left regions partitioned by the partition plates 4H and 5H in the longitudinal direction of the partition walls 4C and 5C so that the first tank portions 6 and 8 of the upper and lower tanks 4 and 5 communicate with the respective second tank portions 7 and 9 of the upper and lower tanks 4 and 5. The function of the refrigerant-distributing holes 4M and 5M is such that a liquid refrigerant contained in a gas-liquid two-phase refrigerant flowing from the right region to the left region, as shown, in the first tank portion 6 of the upper tank 4 in the longitudinal direction of the partition wall 4C flows into the right region, as shown, of the second tank portion 7 while being substantially evenly distributed in the longitudinal direction thereof.

With the partition plate 5H provided in the first tank portion 8 of the lower tank 5, to which the refrigerant inlet header 10 is connected, and the partition plate 4H provided in the second tank portion 7 of the upper tank 4, to which the refrigerant outlet header 11 is connected, the refrigerant supply channel inside the refrigerant evaporator 1 is divided into three blocks, namely, a first block 14, a second block (U-turn block) 15, and a third block 16, as described below. The first block 14 is a block where the refrigerant flowing into the first tank portion 8 of the lower tank 5 through the refrigerant inlet header 10 flows into the first tank portion 6 of the upper tank 4 through the plurality of refrigerant tubes 2 connected to the region to the right of the partition plate 5H.

The second block (U-turn block) 15 is a block where the refrigerant flowing into the first tank portion 6 of the upper tank 4 flows to the left region, as shown, along the partition wall 4C, is substantially evenly distributed over the region of the second tank portion 7 to the left of the partition plate 4H in the longitudinal direction thereof through the plurality of refrigerant-distributing holes 4M, and flows down from both the first tank portion 6 and the second tank portion 7 into the first tank portion 8 and the second tank portion 9 of the lower tank 5 through the plurality of refrigerant tubes 2; the second block 15 is also called a U-turn block. The third block 16 is a block where the refrigerant flowing down into the first tank portion 8 and the second tank portion 9 of the lower tank 5 is collected in the second tank portion 9 through the refrigerant-distributing holes 5M, flows to the right region along the partition wall 5C, and flows into the second tank portion 7 of the upper tank 4 through the plurality of refrigerant tubes 2.

The refrigerant flowing into the second tank portion 7 of the upper tank 4 flows out into the refrigerant outlet pipe 13 through the outlet header 11.

The embodiment described above provides the following effects and advantages.

The gas-liquid two-phase refrigerant flowing from the refrigerant inlet pipe 12 into the first tank portion 8 of the lower tank 5 through the refrigerant inlet header 10 is partially evaporated by heat exchange with the air A through the heat transfer fins 3 while flowing toward the first tank portion 6 of the upper tank 4 through the plurality of refrigerant tubes 2 in the first block 14. The refrigerant collected in the first tank portion 6 of the upper tank 4 flows to the left region in the first tank portion 6 to enter the second block (U-turn block) 15. The gas-liquid two-phase refrigerant flowing into the second block (U-turn block) 15 is evenly distributed over the second tank portion 7 through the refrigerant-distributing holes 4M provided in the partition wall 4C while flowing through the first tank portion 6.

The refrigerant evenly distributed over the first and second tank portions 6 and 7 of the upper tank 4 in the second block (U-turn block) 15 is further evaporated by heat exchange with the air A through the heat transfer fins 3 while flowing down toward the first and second tank portions 8 and 9 of the lower tank 5 through the plurality of refrigerant tubes 2 in the second block (U-turn block) 15. The refrigerant flowing down into the first and second tank portions 8 and 9 of the lower tank 5 is collected in the second tank portion 9 and flows to the right region in the second tank portion 9 to enter the third block 16. The refrigerant is completely evaporated by heat exchange with the air A while rising toward and being collected in the second tank portion 7 of the upper tank 4 through the plurality of refrigerant tubes 2 in the third block 16. The air A, which has been cooled by the heat exchange with the refrigerant, is supplied to an air conditioner in a vehicle cabin, whereas the evaporated refrigerant is recovered into a compressor through the outlet header 11 and the refrigerant outlet pipe 13 to be circulated through a refrigeration cycle.

Figure 4:
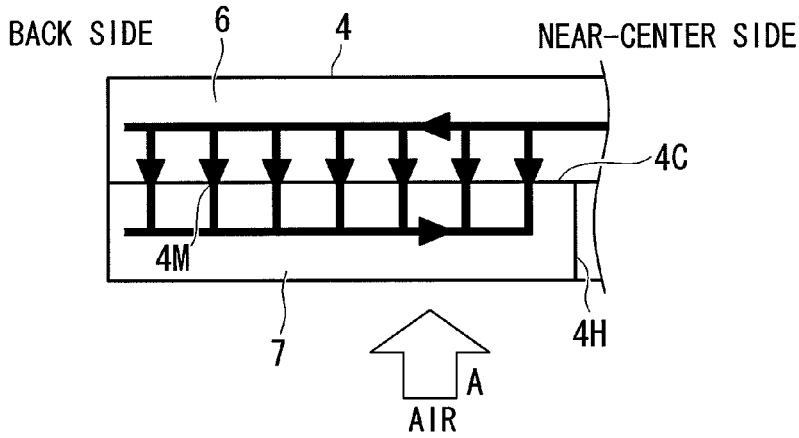
FIG. 4 is a plan view showing how a refrigerant is distributed in a U-turn block of the refrigerant evaporator shown in FIG. 1.

In the second block (U-turn block) 15, where the refrigerant reverses in the upper tank 4, as described above, the gas-liquid two-phase refrigerant flowing into the first tank portion 6 of the upper tank 4 along the partition wall 4C, as shown in FIG. 4, is sequentially distributed from the near side to the second tank portion 7 through the plurality of refrigerant-distributing holes 4M arranged in the longitudinal direction of the partition wall 4C. The liquid refrigerant can therefore flow substantially evenly into the entire region of the second tank portion 7 in the longitudinal direction thereof. This allows the liquid refrigerant to be substantially evenly distributed to the plurality of refrigerant tubes 2 connected to the first and second tank portions 6 and 7 in the second block 15.

In particular, therefore, the above refrigerant evaporator 1 enables improved distribution of the liquid refrigerant between the first and second tank portions 6 and 7 in the U-turn block 15, so that the distribution of the liquid refrigerant to the plurality of refrigerant tubes 2, which contributes to the cooling of the external fluid, namely, the air A, becomes more even, thus improving the heat-exchange performance of the refrigerant evaporator 1.

Figure 6A:
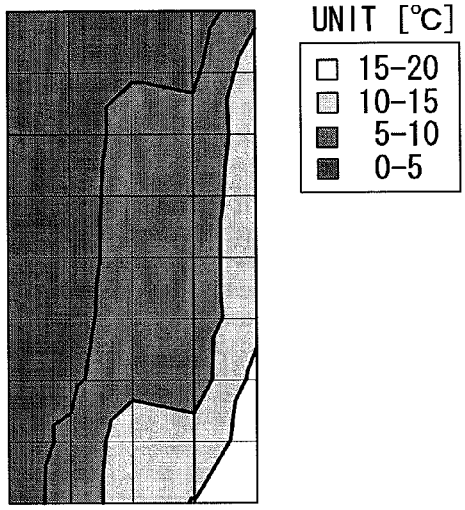
FIG. 6A is a schematic diagram (thermography diagram) showing the refrigerant distribution in the U-turn block of the refrigerant evaporator according to the present invention contrasted with that of a conventional refrigerant evaporator.
Figure 6B:
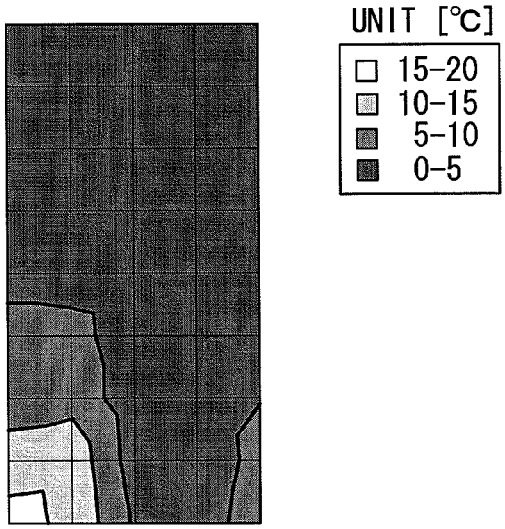
FIG. 6B is a schematic diagram (thermography diagram) showing the refrigerant distribution in the U-turn block of the refrigerant evaporator according to the present invention contrasted with that of a conventional refrigerant evaporator.
Figure 6C:
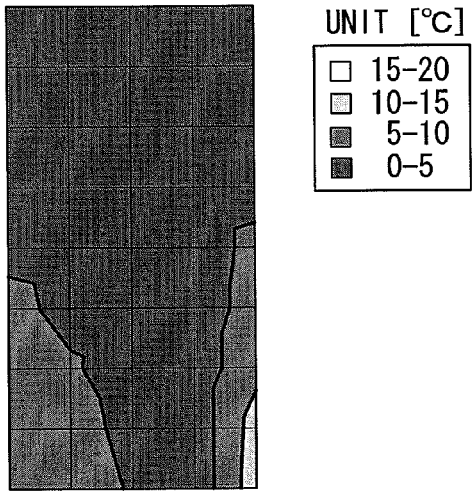
FIG. 6C is a schematic diagram (thermography diagram) showing the refrigerant distribution in the U-turn block of the refrigerant evaporator according to the present invention contrasted with that of a conventional refrigerant evaporator.
Figure 7:
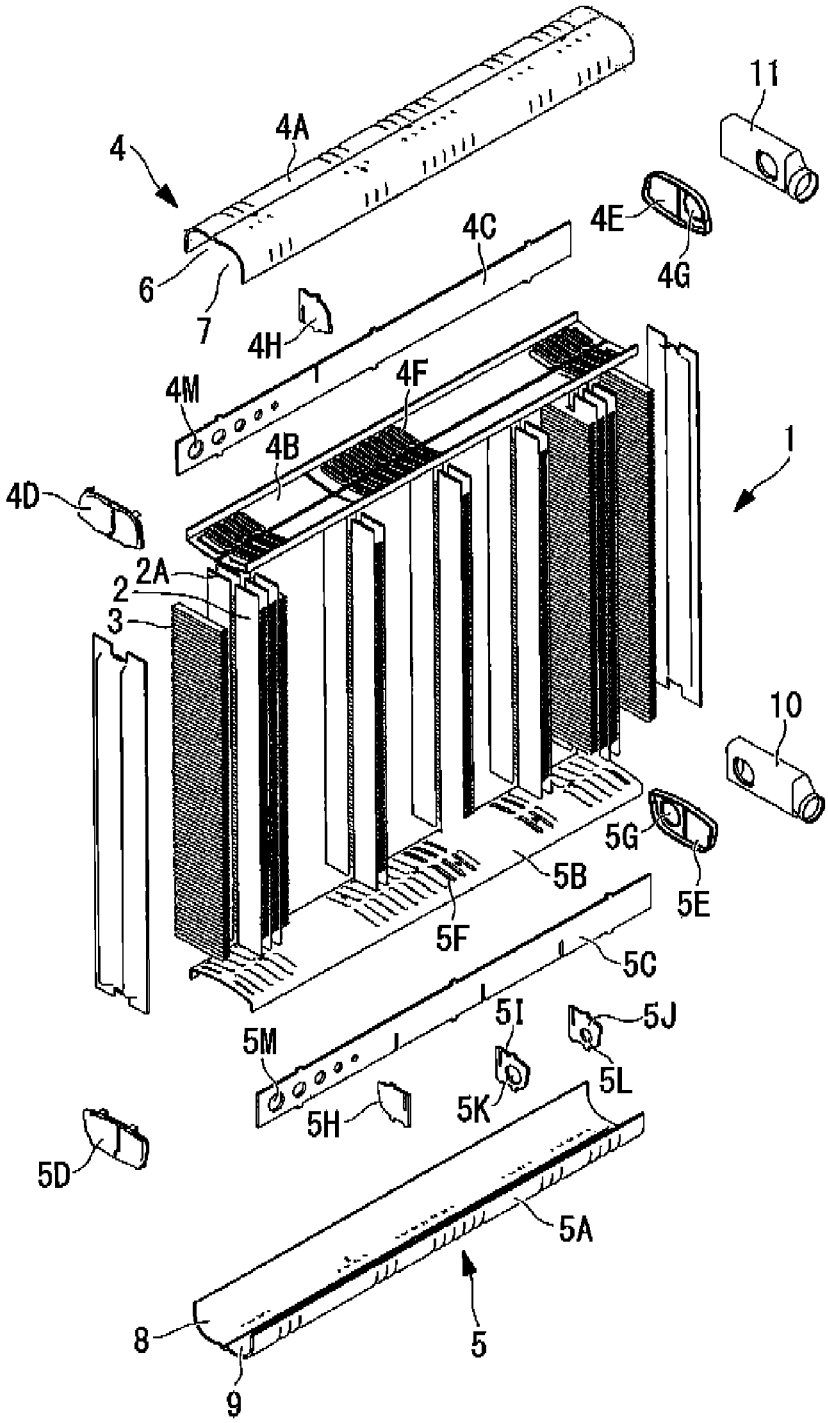
FIG. 7 is an exploded perspective view of a refrigerant evaporator.

FIGS. 6A, 6B, and 6C are schematic diagrams showing the refrigerant distribution of the second block (U-turn block) 15 contrasted with that of the refrigerant evaporator described in Patent Document 1. These diagrams are schematic thermography diagrams visualizing the respective refrigerant distributions on the air entrance side, showing that a site where the liquid refrigerant is concentrated has a lower surface temperature and that a site where the gaseous refrigerant is concentrated has a higher surface temperature. The conditions of the air A are such that the air speed is 1.5 m/s, the dry-bulb temperature is 27° C., and the wet-bulb temperature is 19.5° C. The refrigerant conditions are such that the temperature is 0° C. and the mass flow rate is 100 kg/h.

FIGS. 6A, 6B, and 6C demonstrate that the refrigerant distribution of the refrigerant evaporator 1 of this embodiment, as shown in FIG. 6B, is superior to that of the refrigerant evaporator described in Patent Document 1, as shown in FIG. 6A, with a significant decrease in the area of the regions with high surface temperature ranges, namely, 10 to 15° C. and 15 to 20° C.

In the above embodiment, as shown in FIGS. 3A and 3B, many ribs 4N and 5N may be integrally formed on the surfaces of the upper members 4A and 5A, respectively, of the headers 4 and 5. The components of the refrigerant evaporator 1 shown in FIG. 2 are not separately brazed; as in a known manner, the refrigerant evaporator 1 is produced by preliminarily assembling all the components, transferring the assembly to a furnace, and brazing them together by heating in the furnace.

Second Embodiment

Next, a second embodiment of the present invention will be described with reference to FIG. 5 and FIGS. 6A, 6B, and 6C.

This embodiment differs from the first embodiment described above in the manner in which the refrigerant-distributing holes 4M and 5M are provided in the partition walls 4C and 5C, respectively. The other features are the same as those of the first embodiment, and a description thereof will therefore be omitted.

Figure 5:
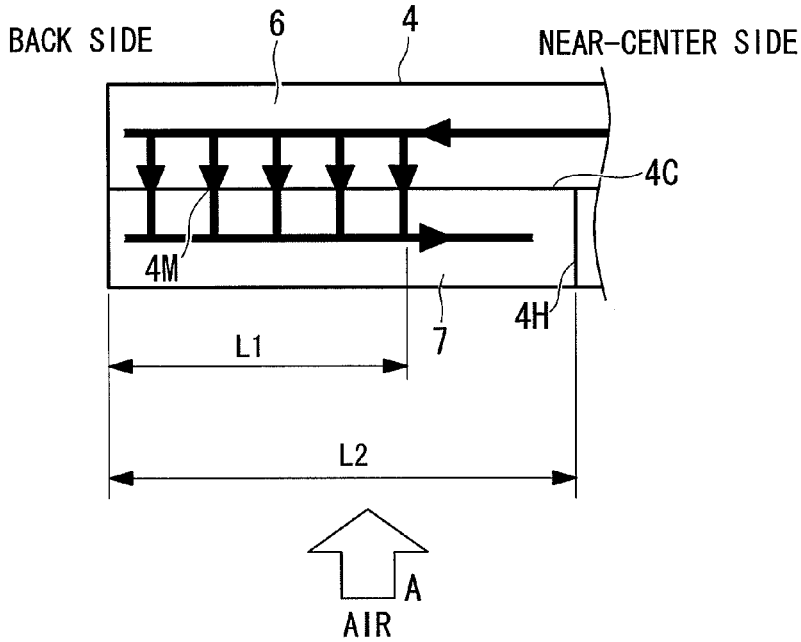
FIG. 5 is a plan view showing how a refrigerant is distributed in a U-turn block of a refrigerant evaporator according to a second embodiment of the present invention.

In this embodiment, as shown in FIG. 5, if the whole length of the upper tank 4, which constitutes the second block (U-turn block) 15, within the second block (U-turn block) 15 in the refrigerant flow direction (the length from the left end of the upper tank 4 to the partition plate 4H) is L2, the plurality of refrigerant-distributing holes 4M and 5M are provided in the partition walls 4C and 5C, respectively, within the length L1 of a far-side region of the second block (U-turn block) 15, excluding its near-side region, in the refrigerant flow direction.

The length L1 of the far-side region is from the farthest end of the first and second tank portions 6 and 7 to the position of the extreme near-side refrigerant-distributing hole 4M. A practical range of the length L1 of the far-side region with respect to the whole length L2 is $0.7<L1/L2<0.9$, and L1/L2 is most preferably about 0.8. FIG. 6C shows a schematic diagram of a refrigerant distribution in the case where L1/L2 is 0.8. This diagram reveals a further improvement in refrigerant distribution as compared with the schematic diagram of the first embodiment shown in FIG. 6B. In this embodiment, therefore, the heat-exchange performance of the refrigerant evaporator 1 can be improved as in the first embodiment.

If L1/L2 falls below 0.7, the liquid refrigerant tends to be slightly insufficiently distributed to the region close to the partition plate 4H in the second tank portion 7; in FIG. 6C, a larger region with high surface temperatures, namely, 10 to 15° C., tends to appear on the lower right side of the diagram. If L1/L2 exceeds 0.9, on the other hand, the liquid refrigerant tends to be slightly insufficiently distributed to the farthest region; in FIG. 6C, a region with high surface temperatures, namely, 10 to 15° C., appears on the lower left side of the diagram. Thus, L1/L2 is most preferably about 0.8.

Third Embodiment

Next, a third embodiment of the present invention will be described.

This embodiment differs from the first and second embodiments described above in that the refrigerant-distributing holes 4M and 5M have different sizes. The other features are the same as those of the first embodiment, and a description thereof will therefore be omitted.

In this embodiment, the size of the plurality of refrigerant-distributing holes 4M and 5M, arranged in the partition walls 4C and 5C in the longitudinal direction thereof, increases gradually from the near side to the far side in the refrigerant flow direction.

If the size of the refrigerant-distributing holes 4M and 5M increases gradually toward the far side in the refrigerant flow direction, as described above, the liquid refrigerant, which tends to be distributed more to the near-side refrigerant-distributing holes 4M by inertia, can be sequentially shifted in distribution to the larger refrigerant-distributing holes 4M on the far side, so that the distribution of the liquid refrigerant, flowing from the first tank portion 6 into the second tank portion 7, in the refrigerant flow direction can be improved. In this embodiment, therefore, the liquid refrigerant can be substantially evenly distributed over the entire region of the first and second tank portions 6 and 7 in the refrigerant flow direction as in the first and second embodiments. Accordingly, the distribution of the liquid refrigerant to the plurality of refrigerant tubes 2 becomes even, thus improving the heat-exchange performance of the refrigerant evaporator 1.

Although the shape of the refrigerant-distributing holes 4M and 5M is not specified in the first to third embodiments, they preferably have a circular shape. This alleviates stress concentration on the portions of the partition walls 4C and 5C in which the refrigerant-distributing holes are provided, thus increasing the pressure strength of the entire tanks. A circular shape is particularly effective as a specification for high-pressure refrigerants, which have increasingly been used recently. In the present invention, however, the shape of the refrigerant-distributing holes 4M and 5M is not limited to a circular shape.

The present invention is not limited to the invention according to the above embodiments; modifications are permitted without departing from the spirit thereof. In the above embodiments, for example, the configuration in which the refrigerant flows from the first tank portion 6 to the second tank portion 7 in the U-turn block 15 has been illustrated as an example, although it is of course possible to employ a configuration in which the refrigerant flows from the second tank portion 7 to the first tank portion 6. In the above embodiments, an example in which the refrigerant supply channel in the refrigerant evaporator 1 is divided into three blocks has been described, although the number of blocks is not limited to three. Furthermore, the refrigerant inlet and outlet may be provided either on the top side or on the bottom side, or on the left side or on the right side, of the refrigerant evaporator 1.

The invention claimed is:

1. A refrigerant evaporator comprising:

a plurality of refrigerant tubes, each refrigerant tube of said plurality of refrigerant tubes having a refrigerant flow channel through which a refrigerant flows in a vertical direction, the plurality of refrigerant tubes being arranged in parallel in a direction perpendicular to a flow direction of an external fluid flowing outside the refrigerant flow channels and being arranged in a plurality of rows from front to rear in the flow direction of the external fluid; and a pair of upper and lower tanks for distributing or collecting the refrigerant, the tanks being disposed in the direction perpendicular to the flow direction of the external fluid and being connected to top ends and bottom ends, respectively, of the many refrigerant tubes, each tank having a partition wall partitioning the interior thereof into a first tank portion and a second tank portion that correspond to the plurality of rows of the refrigerant tubes in a row direction, wherein the first tank portion of the lower tank has a refrigerant inlet, and the second tank portion of the upper tank has a refrigerant outlet, the refrigerant flowing in through the refrigerant inlet, flowing sequentially into the refrigerant tubes in a plurality of blocks partitioned by partition plates disposed at a plurality of positions in the upper tank and partitioning each of the second tank portion and the first tank portion into two regions, and flowing out through the refrigerant outlet, wherein one of the plurality of blocks is a U-turn block where the refrigerant flows into the first tank portion of the upper tank in a direction along the partition wall, flows into the second tank portion of the upper tank, and is distributed and flows from the first and second tank portions of the upper tank into the plurality of refrigerant tubes, and wherein the partition wall partitioning the first and second tank portions of the upper tank has a plurality of refrigerant-distributing holes concentrated in a far-side region of the U-turn block, excluding a near-side region of the U-turn block, in a refrigerant flow direction, arranged in a longitudinal direction of the partition wall in the U-turn block so that the first tank portion of the upper tank communicates with the second tank portion of the upper tank.

2. The refrigerant evaporator according to claim 1, wherein if the length from the farthest end of the U-turn block to the position of the extreme near-side refrigerant-distributing hole in the refrigerant flow direction is L1 and the whole length of the U-turn block in the refrigerant flow direction is L2, the far-side region where the refrigerant-distributing holes are provided satisfies $0.7 < L1/L2 < 0.9$.

3. The refrigerant evaporator according to claim 1, wherein the opening area of the plurality of refrigerant-distributing holes increases gradually from a near side to a far side of the U-turn block in the refrigerant flow direction.

4. The refrigerant evaporator according to claim 1, wherein the refrigerant-distributing holes are circular holes.

* * * * *